US005476057A

United States Patent [19]

Pauly et al.

[11] Patent Number: 5,476,057

[45] Date of Patent: Dec. 19, 1995

[54] METHOD AND APPARATUS FOR STRUCTURALLY SUPPORTING AND SEALING A MAST

[76] Inventors: Gary L. Pauly, 717 Westchester, Grosse Pointe Park, Mich. 48230; James Michaud, 4655 Point Comfort Rd., Green Bay, Wis. 54301

[21] Appl. No.: 205,214

[22] Filed: Mar. 3, 1994

[51] Int. Cl.[6] ..... B63B 15/00

[52] U.S. Cl. ..... 114/93; 114/39.001

[58] Field of Search ..... 114/39.1, 89, 357, 114/90, 86, 93; 446/153, 160; 264/262, 232, 35, 261, 255; 404/69; 277/6, 178, 12, 227, 89, 152–162

[56] References Cited

U.S. PATENT DOCUMENTS

| | | | |
|---|---|---|---|
| 197,980 | 12/1877 | Robbins | 114/93 |
| 2,677,633 | 5/1954 | Gross | 114/86 |
| 2,680,921 | 6/1954 | Gowland | 446/160 |
| 4,046,091 | 9/1977 | Lomas, III et al. | 114/357 |
| 4,951,588 | 8/1990 | Hillman | 114/93 |
| 5,097,781 | 3/1992 | Meny | 114/93 |
| 5,115,552 | 5/1992 | Mattson | 264/262 |

FOREIGN PATENT DOCUMENTS

| | | | |
|---|---|---|---|
| 506890 | 6/1939 | United Kingdom | 264/35 |

*Primary Examiner*—Edwin L. Swinehart
*Attorney, Agent, or Firm*—Harness, Dickey & Pierce

[57] ABSTRACT

A sealing and supporting member for filling the gap between a keel mounted mast and the deck of a sailboat is produced by introducing a sealing compound in a fluidic state into the gap and allowing the sealing compound to cure and create the sealing and supporting member which sealingly engages both the mast and the deck.

14 Claims, 2 Drawing Sheets

METHOD AND APPARATUS FOR STRUCTURALLY SUPPORTING AND SEALING A MAST

FIELD OF THE INVENTION

The present invention relates to a method and apparatus for sealing and structurally supporting a mast at the deck of a sailboat. More particularly, the present invention relates to a method and apparatus for forming a removable water tight seal and supporting member between a sailboat mast and the deck of the sailboat.

BACKGROUND OF THE INVENTION

It has been a long standing problem with sailboat owners having sailboats with keel stepped masts to seal the mast to stop water from leaking through the area where the mast and the sailboat deck meet and filling the void in this area with structural support, both of which must be removable. This leaking around the mast is both an annoying and a damaging problem, while the structural support is vital to the basics of sailing and safety.

Sailboats normally use either a deck stepped mast or a keel stepped mast. Smaller sailboats are normally equipped with a deck stepped mast which does not extend through the deck of the sailboat. Since the mast does not extend through the deck there is no hole in the deck and thus no problems associated with water leakage and structural support between the mast and the deck.

Large sailboats are normally equipped with a keel stepped mast. In a keel stepped mast, the mast is secured to the keel of the sailboat and it extends through a hole in the deck of the sailboat. A collar is usually mounted in the vicinity of the deck opening to aid in the support of the mast and the collar normally includes some type of flange angularly disposed relative to the deck surface to provide for the attachment of rigging via holes in the flange. The collar may also include an upstanding rim disposed in spaced parallel relation with the mast to provide for the sealing and support of the mast while allowing movement of the mast within the collar. Water around the mast can leak through the deck opening between the collar rim and the mast into the areas below the deck. Therefore, the areas below the deck must be regularly inspected for water leakage and any detected water promptly removed to avoid water damage and corrosion. Consequently, keel stepped masts are associated with increased maintenance and inconvenience, as well as potential costs for water damage repair, and such disadvantages detract from the benefits of increased strength obtained with keel stepped masts.

One prior art method of sealing and structurally supporting the keel stepped masts has been to place wedges between the mast and the rim on the collar to support the mast. The remaining space between the mast and the collar is filled with caulking compound and a canvas or rubber boot is placed over the mast and the rim on the collar to seal the opening. Large hose type clamps are then used to secure the boot to the collar rim and the mast. Since the mast is not normally a round shape, hose type clamps cannot distribute an even pressure around the entire circumference of the boot and therefore they do not seal correctly and furthermore, wedges put uneven stresses on the mast by supporting the mast at small localized areas. The prior art caulking compounds can become thinner when the temperature rises which can cause the compound to drip down into the cabin area and create a mess. Under the flexing movement of the mast, the bond of the caulking compound, which relies on adhesion, breaks down and allows the water on the deck to leak into the cabin area. This flexing movement of the mast will also cause the wedges to be distorted and/or moved.

Other prior art methods of sealing and supporting the keel stepped masts has been to force some type of resilient ring between the collar and the mast and then attempt to hold this ring in position by some type of clamping system. The problems associated with these designs include the high cost of manufacturing and installing the various clamping systems, the use of wedges for supporting the mast, the non-uniformity of the masts and deck openings and the tendency for the resilient ring to work its way out of position therefore eliminating the seal and allowing the system to leak or to become structurally unsound.

Accordingly, what is needed is a simple and inexpensive method of sealing and structurally supporting a keel stepped mast between the mast and the deck of the sailboat. The method should be inexpensive and simple to use, while at the same time allowing easy disassembly for permitting the mast to be removed from the sailboat at the end of the season or for the inspection of the mast and/or deck joint.

SUMMARY OF THE INVENTION

The present invention provides the art with a method and apparatus for sealing and structurally supporting a keel stepped mast between the mast and the deck of a sailboat by forming, in place, a sealing and supporting member in the gap between the mast collar and the mast. Once the mast has been positioned, the lower portion of the gap between the mast and the collar is closed off preferably using a molding compound to create a closed annular pocket around the mast. The mast and the collar can then be coated with a mold releasing agent and a sealing compound is introduced into the annular pocket. The sealing compound has the initial capability of flowing into the annular cavity and create a seal between the mast and the collar. The sealing compound is then allowed to cure to create a flexible sealing and structural supporting member fully sealing and supporting the keel stepped mast between the mast and the deck. The use of the mold release agent will permit a simplified disassembly of the sealing and supporting member by allowing it to be pushed out from the area between the mast and the collar in one piece when it is time to remove the mast.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
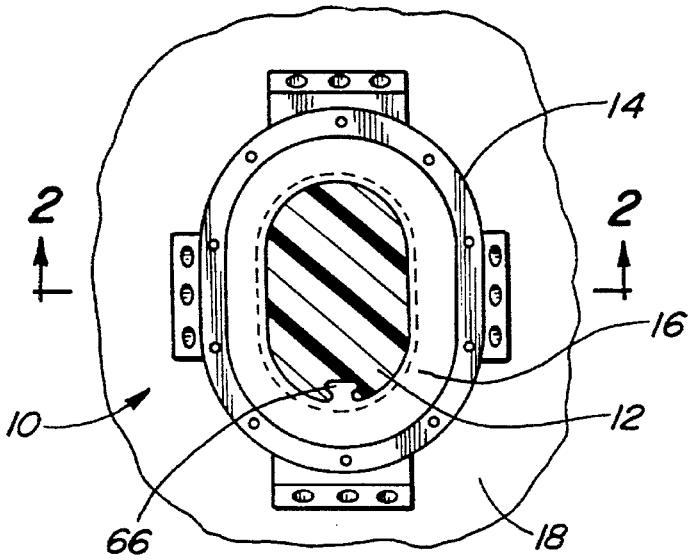
FIG. 1 illustrates a top view of a typical mast/deck joint for a keel stepped mast incorporating the sealing system of the present invention.
Figure 2:
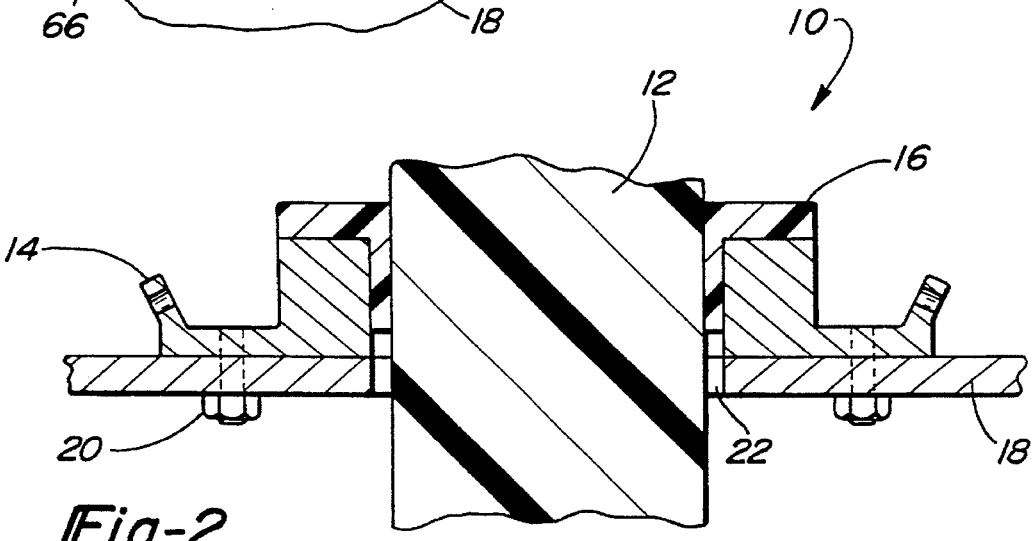
FIG. 2 illustrates a sectional view in the direction of arrows 2—2 of FIG. 1.
Figure 3:
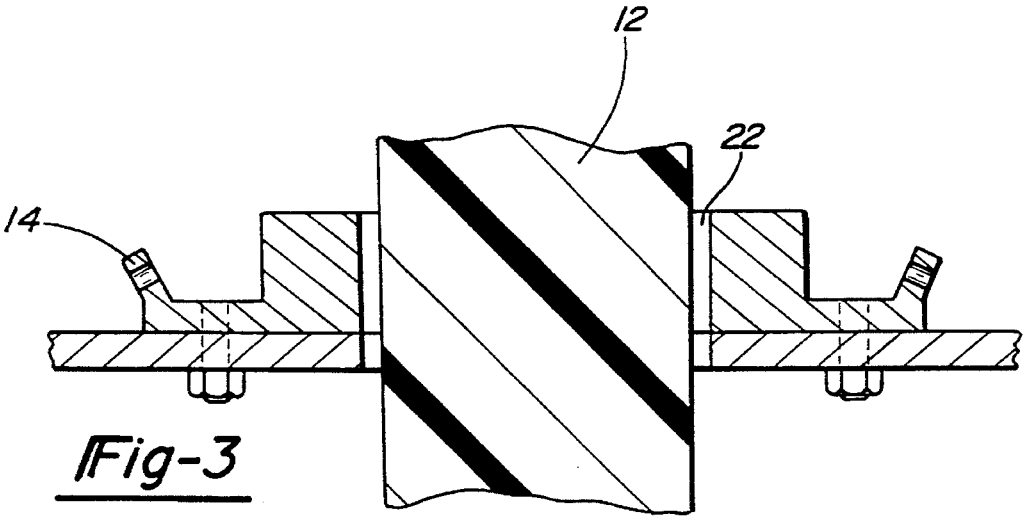
FIG. 3 is a view similar to FIG. 2 but prior to the incorporation of the sealing system of the present invention.

Referring now to the drawings in which like reference numerals designate like or corresponding parts throughout the several views, there is shown in FIGS. 1 and 2 a sealing and supporting system for a keel mounted mast which is designated generally by the reference numeral 10. Sealing and supporting system 10 is formed between a mast 12 and a deck collar 14 and includes a formed in place sealing and supporting member 16. Deck collar 14 is secured to a sailboat deck 18 by a plurality of bolts 20 or by any other method known in the art. Mast 12 is a typical keel mounted mast which can be manufactured from wood, aluminum, plastic composites, carbon fiber or other materials.

As shown in FIG. 2, mast 12 extends through deck collar 14 and deck 18 to form an annular gap 22 between mast 12 and collar 14 which extends from the top of collar 14 to the bottom of deck 18. Assuming that collar 14 and mast 12 are of a similar shape, when mast 12 is centered within collar 14, gap 22 is generally of uniform thickness all around mast 12. When mast 12 is being positioned with respect to the sailboat, mast 12 is free to move within gap 22 and the final position of mast 12 will probably create a non-uniform gap 22 around mast 12. This non-uniform gap 22 can present problems for the prior art resilient ring type of sealing systems as the sealing ring, which is of uniform cross section, is required to compress different amounts depending upon the width of gap 22 at a specified location around mast 12. The present invention eliminates this problem because the sealing and supporting member 16 is formed in place and is capable of conforming to any shape including the shape of gap 22.

Figure 4:
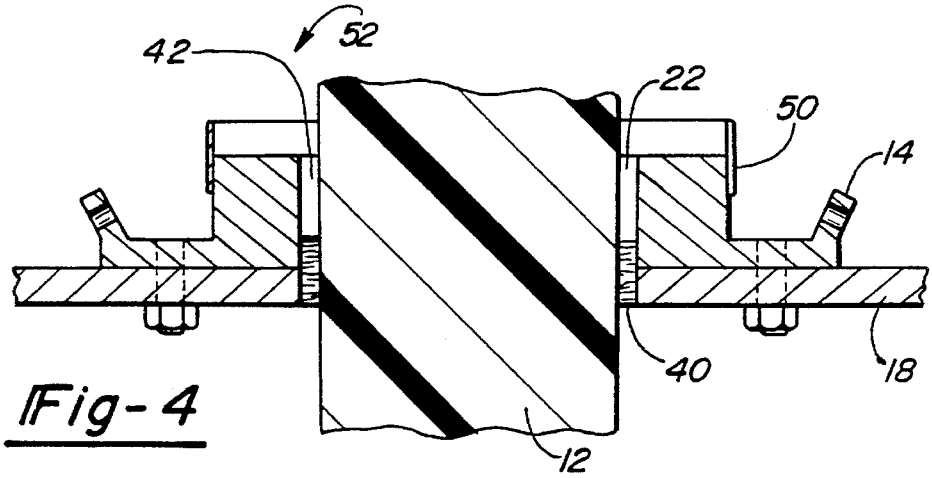
FIG. 4 is a view similar to FIG. 3 but incorporating the molding compound of the present invention.

Once mast 12 has been positioned with respect to deck collar 14, a molding compound 40 is inserted into the lower portion of gap 22 as shown in FIG. 4. Molding compound 40 closes off the lower end of gap 22 to create a closed annular pocket 42. While various materials can be used for molding compound 40, it is preferred that modeling clay be used. Molding compound 40 is first kneaded until it is pliable and it is then packed into gap 22 to form pocket 42. Using an appropriate tool such as a knife, a screwdriver or other tool, molding compound 40 is fitted within gap 22 to form a tight seal between collar 14 and mast 12 and form pocket 42. This tight seal is required in order to enable the sealing compound to be held in place while it cures to form sealing and supporting member 16 as will be discussed later herein.

Upon the completion of forming pocket 42 with molding compound 40, both the interior surface of collar 14 and the exterior surface of mast 12 located within pocket 42 are coated with a releasing agent (not shown). The preferred releasing agent is a high quality petroleum jelly. Mast 12 should be coated with the releasing agent slightly above the height of collar 14 in order to insure that all areas of the mast which come in contact with the sealing compound are coated with the releasing agent.

Figure 5:
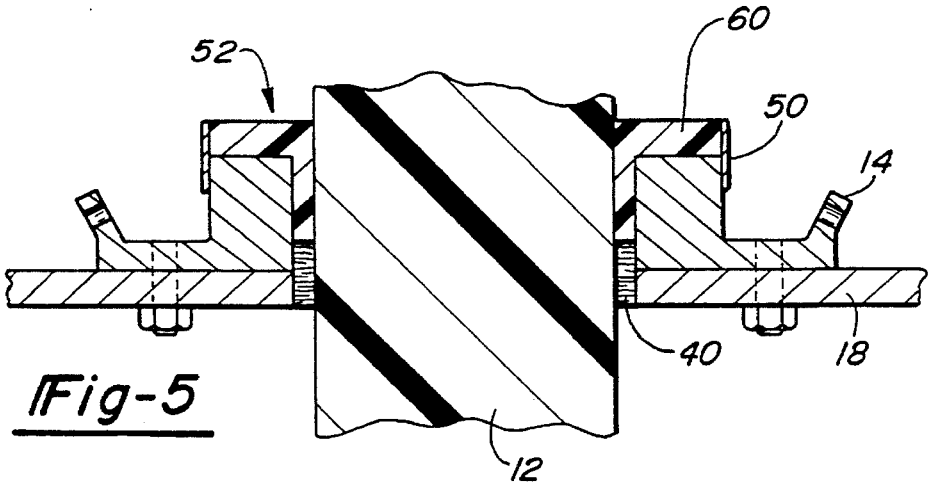
FIG. 5 is a view similar to FIG. 3 but incorporating the molding compound and the sealing compound of the present invention.

Once the releasing agent has been applied, an annular wall 50 is formed around the exterior portion of collar 14 as shown in FIGS. 4 and 5. Annular wall 50 is preferably formed using conventional masking tape, or the like, such that annular wall 50 extends approximately one inch above the top surface of collar 14 as shown in FIGS. 4 and 5. Annular wall 50 serves as the outer barrier for containing the sealing compound so it must be insured that a tight seal is maintained between annular wall 50 and collar 14 for the entire circumference of collar 14. Annular wall 50 in conjunction with pocket 42 form a mold 52 which is used to form sealing and supporting member 16 in place.

When the forming of mold 52 is complete, a sealing compound 60 is introduced into mold 52 by pouring sealing compound 60 into mold 52 from the top. The preferred material for compound 60 is a two-part prepolymer urethane manufactured by Conap, Inc. This two-part prepolymer urethane is available in various formulations which will, upon curing, produce sealing and supporting members 16 having a variety of hardness in order to tailor the proper hardness of urethane to the specific sailboat application. Sealing compound 60 is prepared by mixing the two-part prepolymer urethane which, when it is in its initial liquid state, is able to be poured into mold 52. In addition, the liquid state of sealing compound 60 allows compound 60 to fill all voids contained within mold 52 to completely seal the keel stepped mast between mast 12 and deck collar 14 as shown in FIG. 5. The liquid state also allows for the sealing of a mainsail track 66, shown in FIG. 1, which is normally disposed along the entire length of mast 12 in order to accommodate the mast manufacturer. Nylon members called "cars" are attached to the edge of the mainsail and the cars travel up and down mainsail track 66. Since mainsail track 66 is not used in the area near deck 18, the present invention is able, because of the initial liquid form of sealing compound 60, to seal this type of mast without an additional operation which is required in the prior art sealing systems.

Mold 52 is filled with sealing compound 60 in its initial liquid state at least up to the upper edge of deck collar 14 and preferably approximately one-quarter inch above the upper surface of deck collar 14.

Sealing compound 60 is then allowed to cure in order to form the hardened sealing and supporting member 16. The cure time for sealing compound 60 will depend upon many factors including but not limited to the composition of sealing compound 60 and the temperature of the environment. After curing of sealing compound 60, annular wall 50 can be removed along with molding compound 40 to produce sealing and supporting system 10 as shown in FIGS. 1 and 2. For lasting and aesthetically pleasing results, the exposed areas of sealing and supporting member 16 may be painted to match the color of deck 18.

Sealing and supporting member 16 is capable of both sealing and supporting mast 12 with respect to deck collar 14 and thus eliminates the need for wedges or other support members for the supporting of mast 12. This is extremely useful for the composite and carbon fiber types of masts where the use of wedges and such between the mast and the deck collar can result in damage to the mast and possibly lead to premature failure of the mast. Still, there may be applications where an owner of a sailboat desires to include the use of wedges or other support members in addition to sealing system 10.

Figure 6:
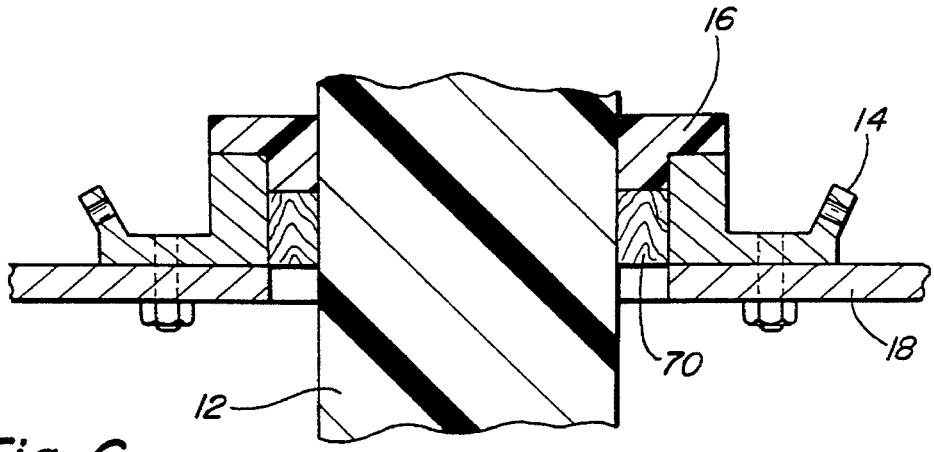
FIG. 6 is a view similar to FIG. 2 but incorporating wedges along with the sealing system of the present invention.

FIG. 6 illustrates the use of sealing and supporting system 10 in conjunction with a plurality of wedges or support members 70. When using support members 70 between mast 12 and deck collar 14, support members 70 should be located at or below what will become the lower surface of sealing member 16. The only difference between the procedure with or without support members 70 is that with support members 70, molding compound 40 must be inserted into the lower portion of gap 22 and around support members 70 which are located during the positioning of mast 12. The locating of molding compound 40 in between support members 70 will then create closed annular pocket 42.

While the above detailed description describes the preferred embodiments of the present invention, it should be understood that the present invention is susceptible to modification, variation and alteration without deviating from the scope and fair meaning of the subjoined claims.

What is claimed is:

1. A method for forming a resilient support member between a mast and a deck, said method comprising the steps of:

positioning said mast within a hole extending through said deck to create an annular gap open at both ends between said mast and said deck;

filling said annular gap with a fluid; and allowing said fluid to cure in order to form said resilient support member.

2. The method according to claim 1 further comprising the step of closing off one end of said annular gap to form a pocket closed at one end.

3. The method according to claim 1 further comprising the step of mixing at least two components to form said fluid.

4. The method according to claim 1 further comprising the step of coating said mast and said deck within said annular gap with a releasing agent.

5. The method according to claim 1 further comprising the step of inserting at least one wedge within said annular gap.

6. The method according to claim 1 wherein said resilient support member sealingly engages said mast and said deck.

7. A method for forming a sealing member sealingly disposed between a mast and a deck, said method comprising the steps of;

positioning said mast within a hole extending through said deck to create an annular gap between said mast and said deck;

closing off a first end of said annular gap to form an annular pocket closed at said first end and open at a second end;

mixing at least two components to form a sealing compound;

filling said annular pocket with said sealing compound; and allowing said sealing compound to cure in order to form said sealing member.

8. The method according to claim 7 wherein said step of positioning said mast within said hole includes inserting at least one wedge between said mast and said deck.

9. The method according to claim 7 wherein said sealing member provides structural support to said mast.

10. A sailboat comprising:

a deck defining a hole;

a mast extending through said hole in said deck to form an annular gap between said mast and said deck, said annular gap being open at both ends;

a self-curing resilient member disposed within said annular gap, said self-curing resilient member conforming to the shape of said annular gap and curing after being disposed within said annular gap.

11. The sailboat according to claim 10 further comprising at least one support member disposed between said deck and said mast.

12. The sailboat according to claim 10 wherein said self-curing resilient member sealingly engages said mast and said deck.

13. The sailboat according to claim 12 wherein said self-curing resilient member provides structural support to said mast.

14. The sailboat according to claim 10 wherein said self-curing resilient member provides structural support to said mast.

* * * * *